US008456370B2

(12) United States Patent
Wu et al.

(10) Patent No.: US 8,456,370 B2
(45) Date of Patent: Jun. 4, 2013

(54) HOUSING AND METHOD FOR MAKING THE SAME

(75) Inventors: Kun-Tsan Wu, Shindian (TW); Li-Wen Tien, Shindian (TW)

(73) Assignee: FIH (Hong Kong) Limited, Kowloon (HK)

( * ) Notice: Subject to any disclaimer, the term of this patent is extended or adjusted under 35 U.S.C. 154(b) by 308 days.

(21) Appl. No.: 12/905,213

(22) Filed: Oct. 15, 2010

(65) Prior Publication Data

US 2011/0316752 A1 Dec. 29, 2011

(30) Foreign Application Priority Data

Jun. 28, 2010 (CN) ..... 2010 1 0211089

(51) Int. Cl.
*H01Q 1/24* (2006.01)

(52) U.S. Cl.
USPC ..... 343/702; 343/718

(58) Field of Classification Search
USPC ..... 343/702, 700 MS, 718, 873
See application file for complete search history.

(56) References Cited

U.S. PATENT DOCUMENTS

| | | | | |
|---|---|---|---|---|
| 6,061,036 | A * | 5/2000 | MacDonald et al. | 343/873 |
| 6,630,911 | B2 * | 10/2003 | Kamei et al. | 343/873 |
| 7,180,451 | B2 * | 2/2007 | Silzer, Jr. | 343/702 |
| 8,259,032 | B1 * | 9/2012 | Buckley | 343/909 |
| 2007/0013600 | A1 * | 1/2007 | Sullivan et al. | 343/873 |

* cited by examiner

*Primary Examiner* — Hoanganh Le
(74) *Attorney, Agent, or Firm* — Altis Law Group, Inc.

(57) ABSTRACT

A housing includes a soft layer, a radiator element, and a main body. The radiator element is combined with the soft layer. The main body is attached to the soft layer, and the radiator element extends from the soft layer and the main body. The radiator element can be protected by the soft layer and the main body. In addition, textured material can be use for the soft layer to enhance appearance of an electronic device using the housing.

3 Claims, 7 Drawing Sheets

HOUSING AND METHOD FOR MAKING THE SAME

BACKGROUND

1. Technical Field

The present disclosure relates to a housing and a method for making the housing.

2. Description of Related Art

Antennas are critical for wireless communication between electronic devices (such as mobile phones, computers, PDAs, and so on). The antenna may be a thin metal radiator element mounted to a support member, and attached to a device's housing. However, the radiator element may be exposed on the housing and easily damaged. In addition, electronic devices commonly have lightweight plastic housing, and although serviceable, are generally not very attractive.

Therefore, there is room for improvement within the art.

BRIEF DESCRIPTION OF THE DRAWINGS

Many aspects of the present housing and method for making the same can be better understood with reference to the following drawings. The components in the various drawings are not necessarily drawn to scale, the emphasis instead being placed upon clearly illustrating the principles of the present disclosure. Moreover, in the drawings, like reference numerals designate corresponding parts throughout the diagrams.

DETAILED DESCRIPTION

Figure 1:
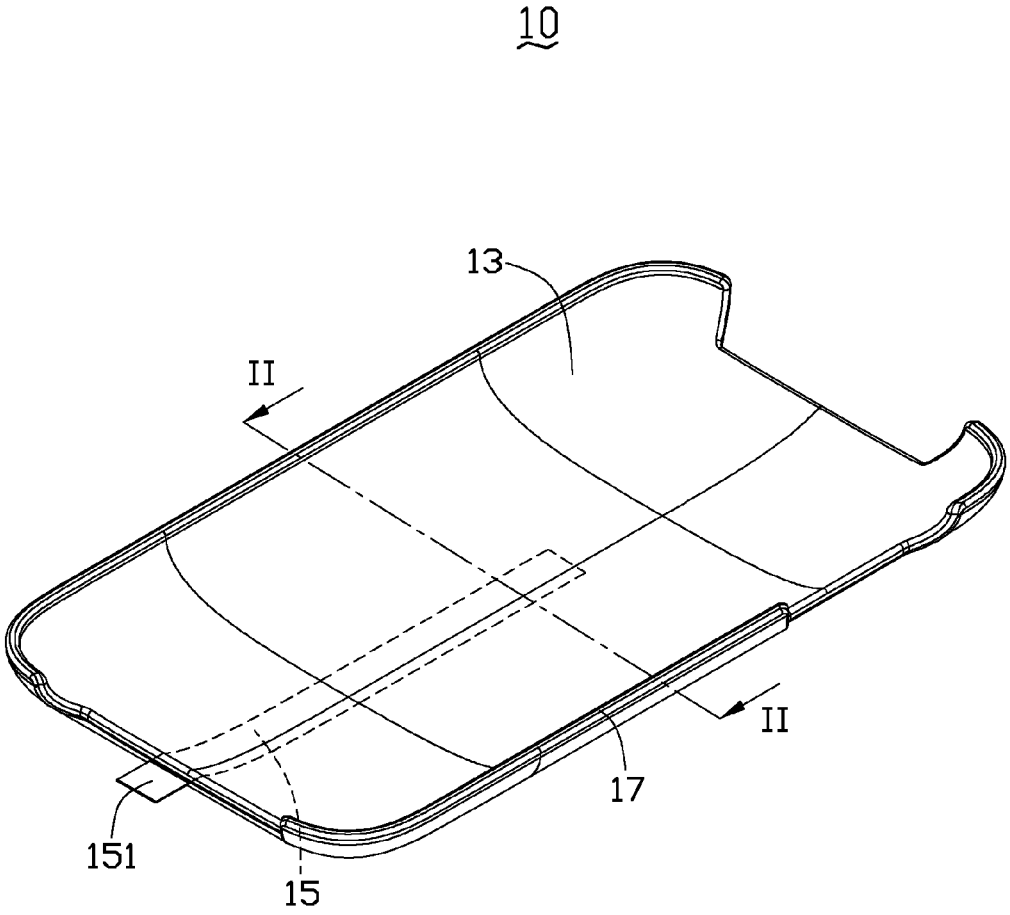
FIG. 1 is an isometric view of an exemplary housing for an electronic device.
Figure 2:
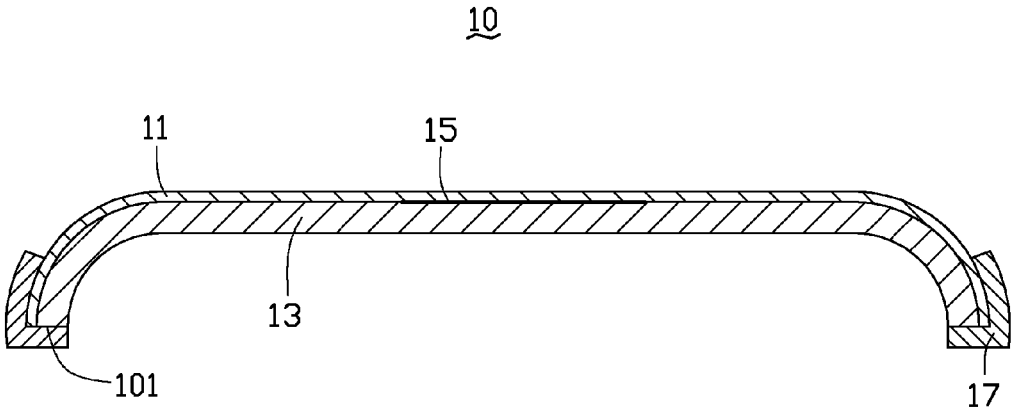
FIG. 2 is a cross-sectional view of the housing of FIG. 1 taken along line II-II.

FIG. 1 and FIG. 2 show an exemplary housing 10 used in an electronic device, such as a mobile phone, a personal digital assistant, and so on. The housing 10 includes a soft layer 11, a main body 13, a radiator element 15, and an edge-covering portion 17.

Figure 3:
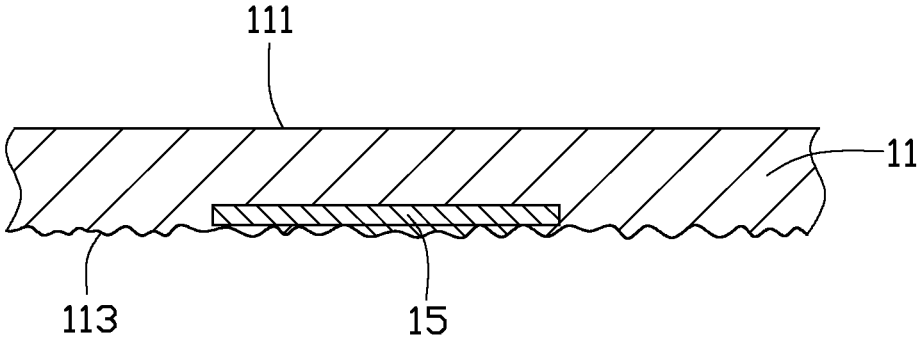
FIG. 3 is a cross-sectional view of a radiator element attached to a soft layer shown in FIG. 2.
Figure 4:
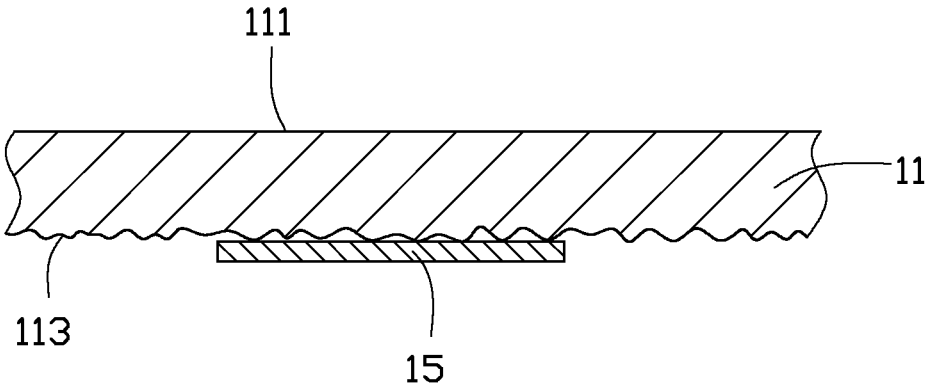
FIG. 4 is a cross-sectional view of a radiator element embedded in the soft layer shown in FIG. 2.

Referring to FIG. 3 and FIG. 4, the soft layer 11 can be made of a soft material such as a fabric. The soft layer 11 includes a first surface 111 and an opposite second surface 113. The first surface 111 is an exterior surface available for ornamentation. The second surface 113 should have a roughened portion, formed by, for example, a plurality of tiny pores or projections. For some soft materials, the pores and projections of the second surface 113 may be a natural property of the material. For other soft materials, the pores and projections may be formed by grinding or sandblasting.

The main body 13 can be formed by injection molding a moldable material. The moldable material can be any of plastic, rubber, and silicone. The plastic material can be any of polyvinylchloride resin (PVC), polyethylene terephthalate (PET), acrylonitrile-butadiene-styrene (ABS), polycarbonate (PC), polyimide (PI), liquid crystal polymer (LCP), polyetherimide (PEI), polyphenylene sulfide (PPS), polystyrene (PS), polypropylene (PP). In particular, ABS and PC are readily adhered to many soft materials. The moldable material may penetrate the tiny pores or settle between the projections of the second surface 113 so that the tiny pores and projections interlock with the moldable material, thereby increasing the bonding of the soft layer 11 to the main body 13.

The radiator element 15 may be a thin metal sheet made of cooper. The radiator element 15 can be embedded in the soft layer 11 adjacent to the second surface 113. The radiator element 15 also can be attached to the second surface 113. Referring to FIG. 1, an end of the element 15 is a terminal 151 exposed from the housing 10 to electrically connect to electronic components disposed in the electronic device.

The edge-covering portion 17 is for enclosing an edge portion 101 of the housing 10 that includes a seam where the soft layer 11 and main body 13 meet. The edge-covering portion 17 can be formed by injection molding a moldable material. The moldable material may be one or more thermoplastic materials selected from a group consisting of polyvinylchloride resin, polyethylene terephthalate, acrylonitrile-butadiene-styrene, polycarbonate, polyimide, liquid crystal polymer, polyetherimide, polyphenylene sulfide, polystyrene, and polypropylene. The edge-covering portion 17 is configured to prevent the soft layer 11 separating from the main body 13 at the seam.

The main body 13 and the second surface 113 of the soft layer 11, at least partially cover the radiator element 15. In this exemplary embodiment, the edge-covering portion 17 covers the edge portion 101 and at least a part of the exterior portion of the soft layer 11.

Figure 5:
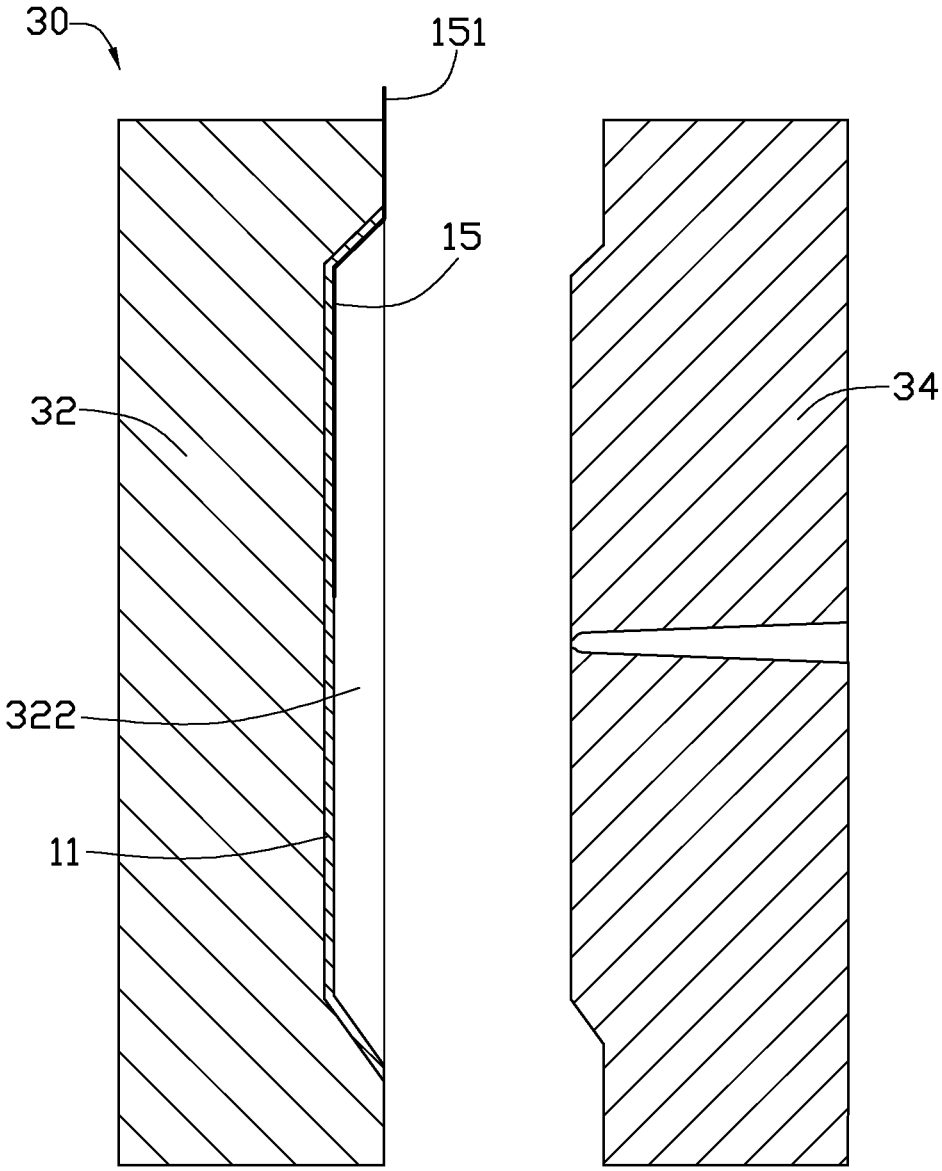
FIG. 5 is a cross-sectional view of the soft layer combined with the radiator element fixed in a first injection mold.
Figure 6:
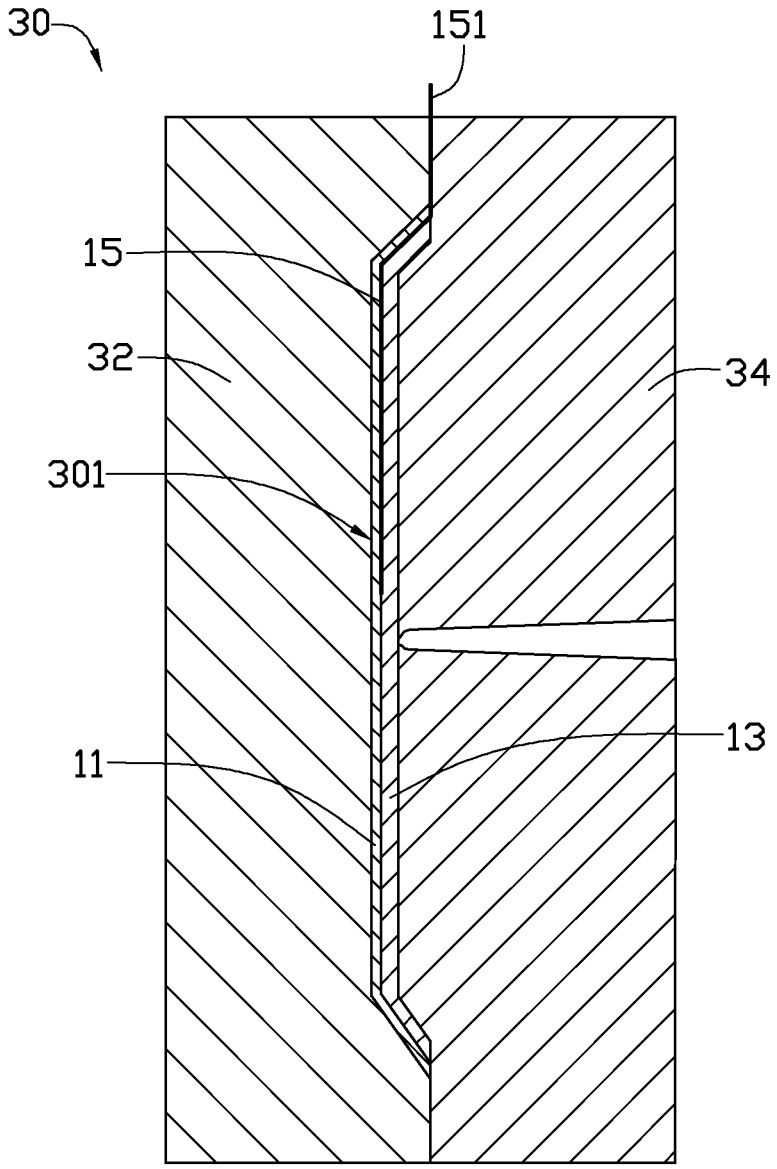
FIG. 6 is a cross-sectional view of a first injection molding process.

Referring to FIG. 5 and FIG. 6, an exemplary embodiment of a method for making the housing 10 may comprise the following steps:

The radiator element 15 is embedded into the soft layer 11 and one end that is the terminal 151 of the radiator element 15 is exposed from the soft layer 11. A first injection molding machine 30 is provided, which includes a first female mold 32 and a first male mold 34 matching with the first female mold 32. The first female mold 32 defines a first cavity 322. The soft layer 11 with the radiator element 15 is fixed in the first cavity 322. The second surface 113 faces the first male mold 34, and the terminal 151 extends from the first cavity 322. Closing the first injection molding machine 30, the terminal 151 is clamped by the first female mold 32 and the first male mold 34. The soft layer 11 is received in a first chamber 301 enclosed by the first female mold 32 and the first male mold 34. Then the thermoplastic material is injected into the first chamber 301 to form the main body 13 attached to the second surface 113 to obtain a pre-finished article.

Figure 7:
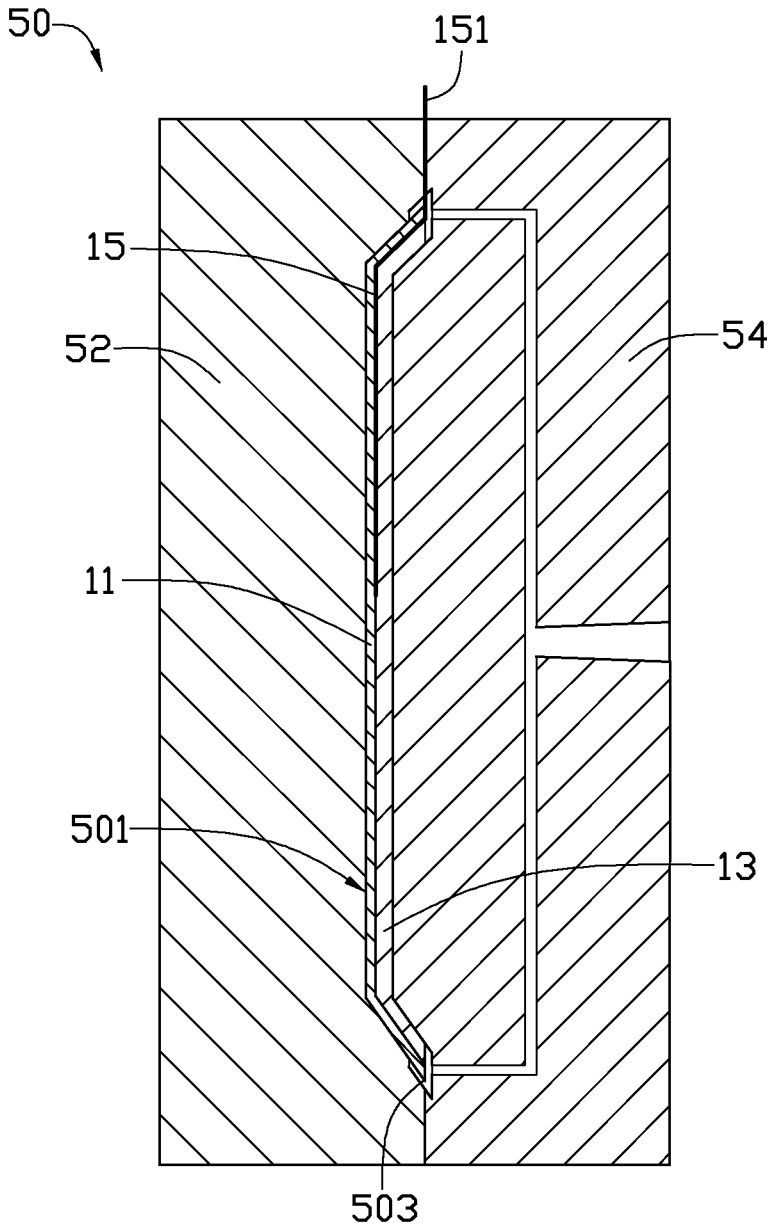
FIG. 7 is a cross-sectional view of a second injection molding process.

Referring to FIG. 7, a second injection molding machine 50 is provided, which includes a second female mold 52 and a second male mold 54 matched to the second female mold 52. The second female mold 52 defines a second cavity (not shown). A second chamber 501 is enclosed by the second female mold 52 and the second male mold 54. The pre-finished article is placed into the second chamber 501 and the terminal 151 extends from the second cavity. The second injection molding machine 50 is closed, and the terminal 151 is clamped by the second female mold 52 and the second male mold 54. The main body 13 and the soft layer 11 are received in the second chamber 501, and remaining space of the second chamber 501 is an injection chamber 503 for forming the edge-covering portion 17. Then the thermoplastic material is injected into the second chamber 501 to fill the injection chamber 503. Thus the edge-covering portion 17 is formed in the injection chamber 503. The edge-covering portion 17 seals the edge portion 101 and at least a part of the exterior portion of the soft layer 11 to form the housing 10. Finally, cooling the second injection molding machine 50, and the housing 10 is taken out of the second injection molding machine 50.

The radiator element 15 is formed between the soft layer 11 and the main body 13, thus, the radiator element 15 is protected. In addition, the housing 10 includes a soft layer 11 which provides an exterior texture that is not so smooth and plain, thus the electronic device has a more attractive appearance.

It is to be understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A housing, comprising:

a fabric layer;

a radiator element combined with the fabric layer; and a main body attached to the fabric layer to sandwich the radiator element between the fabric layer and the main body, the radiator element including an end extending from the housing;

wherein the radiator element is embedded into the fabric layer, the housing further comprises an edge-covering portion covering at least a part of the exterior portion of the fabric layer and an edge portion of the main body.

2. The housing as claimed in claim 1, wherein the edge portion comprises a seam where the fabric layer and main body meet.

3. The housing as claimed in claim 1, wherein the radiator element extends from the fabric layer.

* * * * *